US006739663B2

(12) United States Patent
Gevaert

(10) Patent No.: US 6,739,663 B2
(45) Date of Patent: May 25, 2004

(54) FLEXIBLE BAR-TYPE BACK PIVOT MOUNTING ARRANGEMENT FOR A CHAIR

(75) Inventor: Steven C. Gevaert, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 10/080,105

(22) Filed: Feb. 21, 2002

(65) Prior Publication Data

US 2002/0117883 A1 Aug. 29, 2002

Related U.S. Application Data

(60) Provisional application No. 60/270,851, filed on Feb. 23, 2001.

(51) Int. Cl.[7] ..... A47C 7/44
(52) U.S. Cl. ..... 297/296; 297/297
(58) Field of Search ..... 297/296, 297

(56) References Cited

U.S. PATENT DOCUMENTS

| | | | | |
|---|---|---|---|---|
| 3,813,148 A | | 5/1974 | Kraus | |
| 4,452,485 A | | 6/1984 | Schuster | |
| 4,549,764 A | | 10/1985 | Haedo | |
| 4,580,836 A | * | 4/1986 | Verney | 297/296 |
| 4,585,272 A | | 4/1986 | Ballarini | |
| 4,603,904 A | | 8/1986 | Tolleson et al. | |
| 4,703,974 A | | 11/1987 | Brauning | |
| 4,787,676 A | | 11/1988 | Neve de Mavergnies | |
| 4,830,430 A | * | 5/1989 | Schafer | 297/298 |
| 4,869,552 A | | 9/1989 | Tolleson et al. | |
| 5,039,163 A | | 8/1991 | Tolleson | |
| 5,108,149 A | * | 4/1992 | Ambasz | 297/342 |
| 5,887,946 A | | 3/1999 | Raftery | |
| 5,904,397 A | | 5/1999 | Fismen | |
| 5,988,746 A | * | 11/1999 | Raftery | 297/297 |
| 6,406,096 B1 | * | 6/2002 | Barile, Sr. | 297/301.3 |

FOREIGN PATENT DOCUMENTS

| | | | | |
|---|---|---|---|---|
| EP | 552388 A1 | * | 7/1993 | A47C/7/14 |
| WO | WO 9103192 A1 | * | 3/1991 | A47C/1/024 |

* cited by examiner

*Primary Examiner*—Peter M. Cuomo
*Assistant Examiner*—Stephen D'Adamo
(74) *Attorney, Agent, or Firm*—Boyle, Fredrickson, Newholm, Stein & Gratz, S.C.

(57) ABSTRACT

A back mounting arrangement for a chair in which a back member is pivotable relative to a seat member. The back mounting arrangement includes a flexible bar-type pivot member interposed between the seat member and the back member. The pivot member includes an upper section received within a passage associated with the back member, and a lower section received within a passage associated with the seat member. The pivot member is formed of a resilient material and is flexible so as to enable the back member to be pivoted rearwardly relative to the seat member, and to provide a forward bias to the back member for resisting rearward pressure applied to the back member. A limit member, in the form of a limit strap, is engaged with the pivot member for limiting rearward pivoting movement of the back member relative to the seat member. The limit strap includes an opening which receives a protrusion associated with the pivot member. The opening is slightly larger than the protrusion, and an edge of the opening engages the protrusion when the pivot member is flexed to a predetermined position, to limit rearward movement of the back member relative to the seat member.

16 Claims, 5 Drawing Sheets

FLEXIBLE BAR-TYPE BACK PIVOT MOUNTING ARRANGEMENT FOR A CHAIR

CROSS-REFERENCE TO RELATED APPLICATIONS

This application claims the benefit of U.S. Provisional Application Ser. No. 60/270,851, filed Feb. 23, 2001 now abandoned.

BACKGROUND AND SUMMARY OF THE INVENTION

This invention relates to seating furniture, and more particularly to an arrangement for pivotably mounting a back to a seat in a chair or other seating furniture arrangement.

Various arrangements are known for providing pivoting movement of a chair back relative to a seat. One example is illustrated in Ambasz U.S. Pat. No. 4,084,850, which discloses a sleeve mounted to each side of a chair back and the upper end of a rod pivotably engaged with the lower end of the sleeve. The rod extends through a passage defined by a cylindrical retainer engaged with the seat, or with an upright extending upwardly from the seat. The rod defines an enlarged lower end, and a spring bears between the lower end of the rod and the lower end of the cylindrical retainer. Pivoting movement of the back causes the rod to move upwardly relative to the cylindrical retainer and functions to compress the spring, such that the spring resists rearward movement of the chair back and provides forward pressure on the user's back. While this type of arrangement has been found to operate satisfactorily, it involves a number of components which must be assembled together in order to effectuate pivotable mounting of the back to the seat.

The '850 patent illustrates other alternative arrangements, including a lever arm extending downwardly from the seat into a passage defined by an upright seat mounting section, with a resilient compressible member being engageable with the lever arm. This arrangement provides compression of the resilient member as the seat is pivoted rearwardly, which resists such rearward movement and provides a forward bias to the back.

It is an object of the present invention to provide a simplified back pivot arrangement for a chair, which reduces the number of parts and assembly steps required to mount the back to the chair, and which provides satisfactory pivoting movement of the back relative to the seat. It is another object of the invention to provide such a back pivot arrangement which is capable of providing progressively increasing resistance during rearward pivoting movement of the back relative to the seat. It is a further object of the invention to provide such a back mounting arrangement which limits pivoting movement of the back relative to the seat without contact between the back and the seat. A still further object of the invention is to provide such a back mounting arrangement which is extremely simple in its components and their construction and assembly, yet which provides highly satisfactory pivoting movement and resistance of the back relative to the seat.

In accordance with the invention, seating furniture such as a chair includes a seat member and a back member, which are formed with facing open pockets or passages. A flexible bar-type pivot member includes a lower section adapted to be received within the seat member passage and an upper section adapted to be received within the back member passage. The seat member and the back member define facing surfaces which are spaced apart from each other, and an intermediate portion of the pivot member is located within the space and between the upper and lower sections of the pivot member. A limit member, which may be in the form of a limit strap, is engaged with the pivot member for limiting rearward movement of the back member relative to the seat member.

The upper and lower ends of the pivot member are fixed relative to the back member and the seat member, respectively. When the back member is in its at-rest position, a gap is defined between the upper section of the pivot member and the rear surface of the back member passage, and a gap is also defined between the lower section of the pivot member and the rear surface of the seat member passage. With this arrangement, the pivot member initially flexes rearwardly to engage the pivot member with the upper end of the seat member passage when initial rearward pressure is applied to the back member. Additional rearward pressure causes engagement of the pivot member with the lower end of the back member passage. Thereafter, resistance to rearward pivoting movement is provided by the intermediate section of the pivot member, which is configured and has a thickness which provides a relatively high degree of resistance.

The limit member overlies the pivot member, and is operable to control the range of movement of the back member relative to the seat member. The limit member and the pivot member define cooperating engagement structure, which is operable to prevent additional bending of the pivot member when the back member has attained a predetermined angular position relative to the seat member. Representatively, the pivot member is provided with upper and lower protrusions which extend from a front surface of the pivot member. The limit member has spaced apart openings which receive the pivot member protrusions, and one or both of the limit strap openings are slightly larger than the pivot member protrusions. During pivoting movement of the back member; the front of the pivot member becomes slightly elongated and the back of the pivot member becomes slightly compressed. In this manner, the limit member opening engages the pivot member protrusion when the back member is pivoted to a predetermined angle relative to the seat member, to prevent further bending of the pivot member and thereby to limit movement of the back member relative to the seat member. When rearward pressure on the back member is relieved, the resiliency of the pivot member and the limit member function to return the back member to its original position.

Various other features, objects and advantages will be made apparent from the following detailed description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
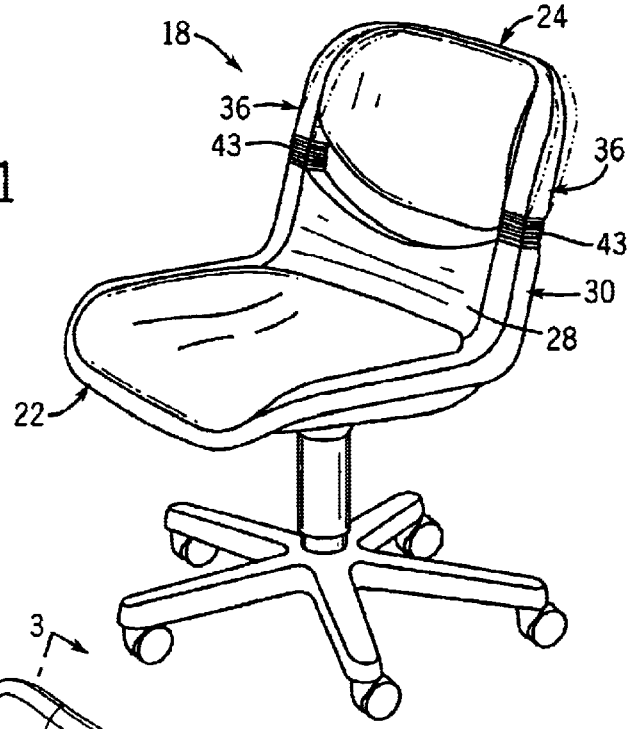
FIG. 1 is an isometric view of a chair incorporating the back mounting arrangement of the present invention.
Figure 2:
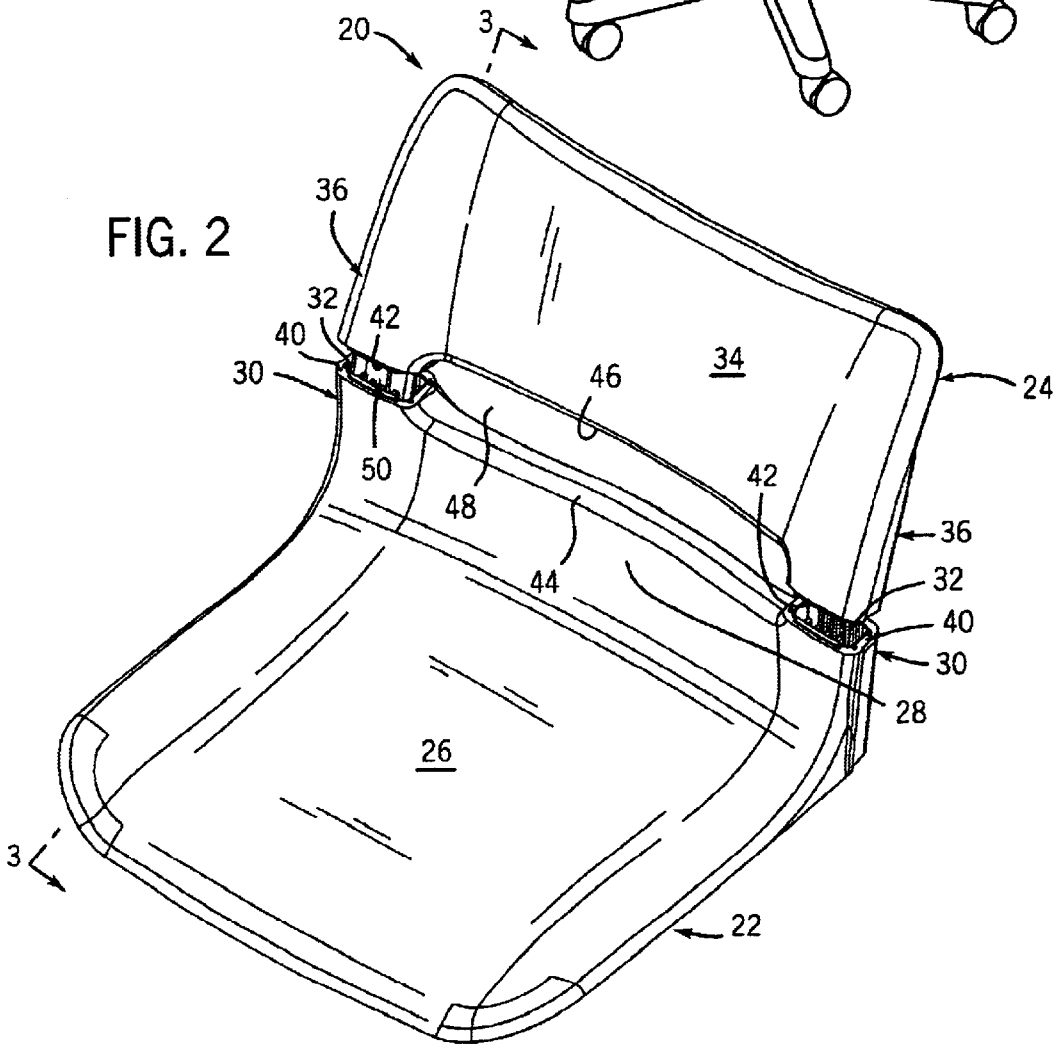
FIG. 2 is an isometric view of a chair shell incorporated into the chair of FIG. 1.

Referring to FIGS. 1 and 2, a chair 18 includes a shell assembly 20 having a seat section or member 22 and a back section or member 24. Seat member 22 includes a seat pan 26 which is curved upwardly at its rear end and merges with a lower back area 28. A pair of upwardly facing lower receiver sections 30 are located one on either side of lower back area 28. Each lower receiver section 30 defines an upwardly open pocket or passage 32.

Back member 24 defines an upper back area 34 and a pair of upper receiver sections 36 located one on either side of upper back area 34. Each upper receiver section 36 defines a downwardly open pocket or passage 38. Lower and upper receiver sections 30, 36, respectively, define facing upper and lower edges 40, 42, respectively, which are spaced apart from each other. A bellows member 43 is engageable with the upper end of each lower receiver section 30 and the lower end of each upper receiver section 36, for concealing the space between lower and upper edges 40, 42, respectively, and for accommodating pivoting movement of back member 24 relative to seat member 22.

Lower back area 28 terminates in a downwardly recessed transverse upper edge 44, and upper back area 34 terminates in an upwardly recessed transverse lower edge 46. Upper edge 44 and lower edge 46 cooperate to define an open area 48 located between lower back area 28 and upper back area 34.

A pair of bar-like resilient pivot members 50 arc engaged with lower receiver sections 30 and upper receiver sections 36, for pivotably mounting back member 24 relative to seat member 22. Each pivot member 50 defines a lower portion received within passage 32 in lower receiver section 30, an upper portion received within passage 38 in upper receiver section 36, and an intermediate area 52 located between upper and lower edges 40, 42 of lower and upper receiver sections 30, 36, respectively, which is concealed by bellows member 43 mounted between upper and lower edges 40, 42, respectively.

Each resilient pivot member 50 is a composite member, including a flexible resilient pivot bar 54 and a limit strap 56.

Figure 3:
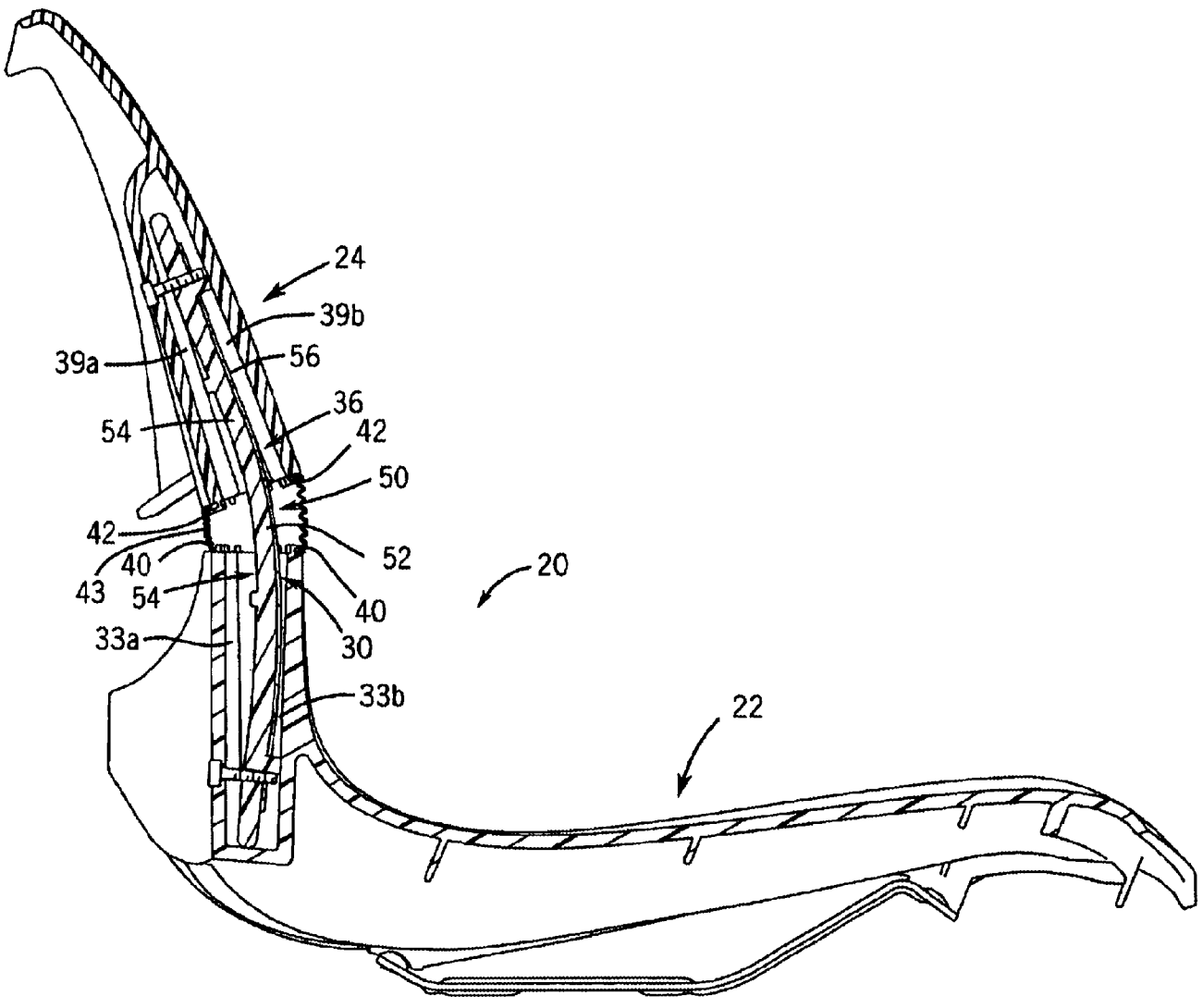
FIG. 3 is a section view taken along line 3—3 of FIG. 2, showing the back member of the chair in its upright position.

Passage 32 in each lower receiver section 30 is in the form of an upwardly facing passage or pocket having rear ribs 33*a* and front ribs 33*b*, within which the lower portions of pivot bar 54 and limit strap 56 are received. Similarly, passage 38 in upper receiver section 36 is in the form of a downwardly facing passage or pocket having front ribs 39*a* and rear ribs 39*b*, within which the upper portions of pivot bar 54 and limit strap 56 are received. FIG. 3 illustrates one of resilient pivot members 50 positioned between seat member 22 and back member 24.

Figure 4:
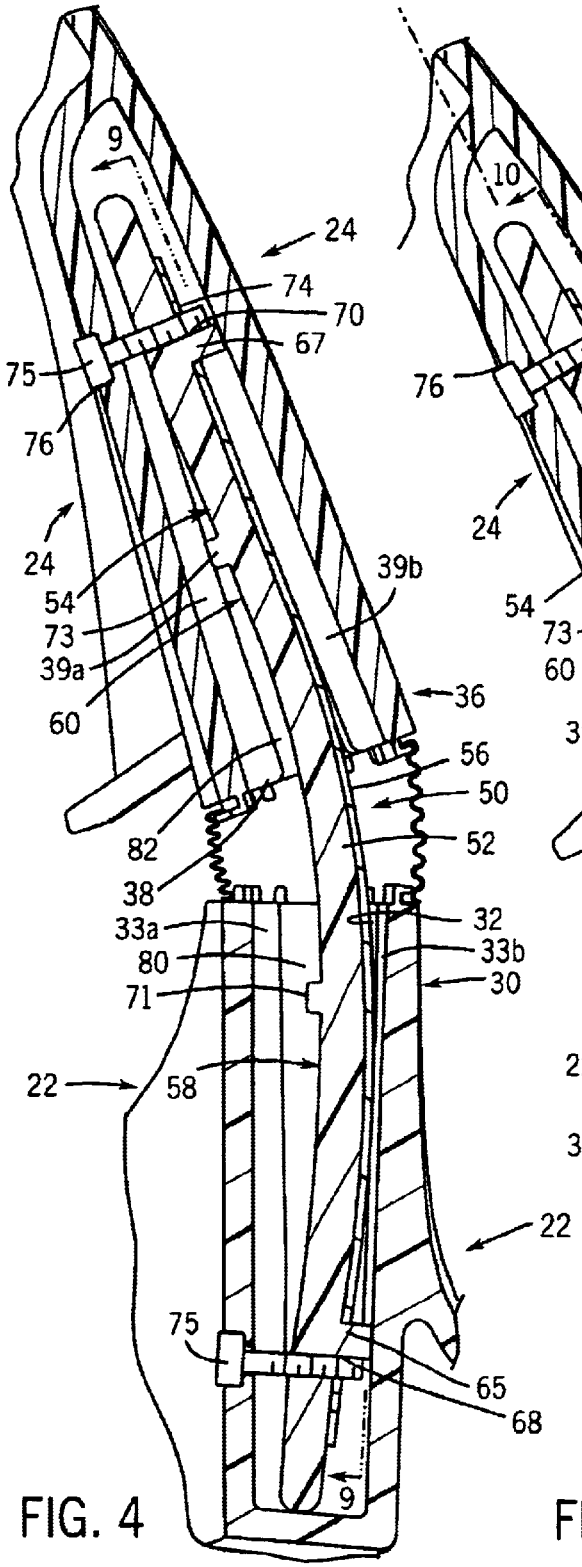
FIG. 4 is an enlarged partial section view showing the components of the back mounting arrangement of FIG. 3, again showing the back member in its upright position.
Figure 5:
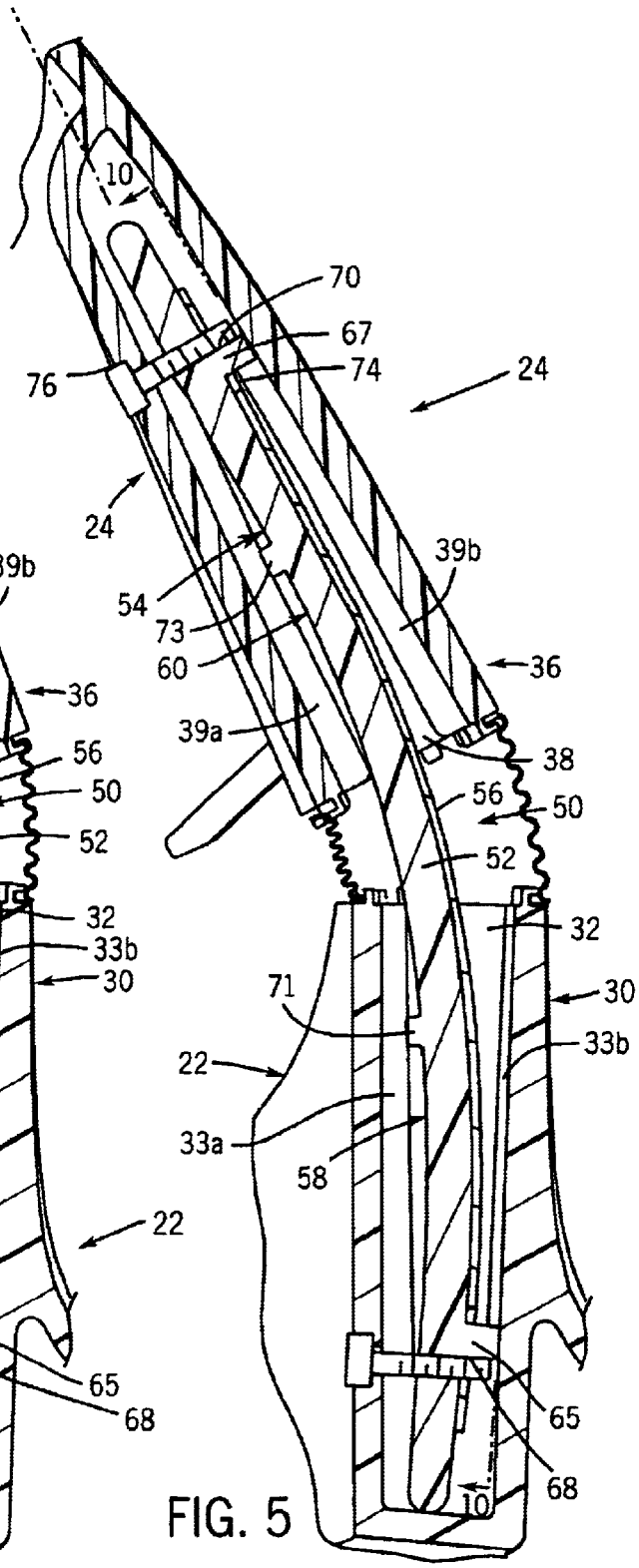
FIG. 5 is a view similar to FIG. 4, showing the back member in its full rearwardmost position.
Figure 6:
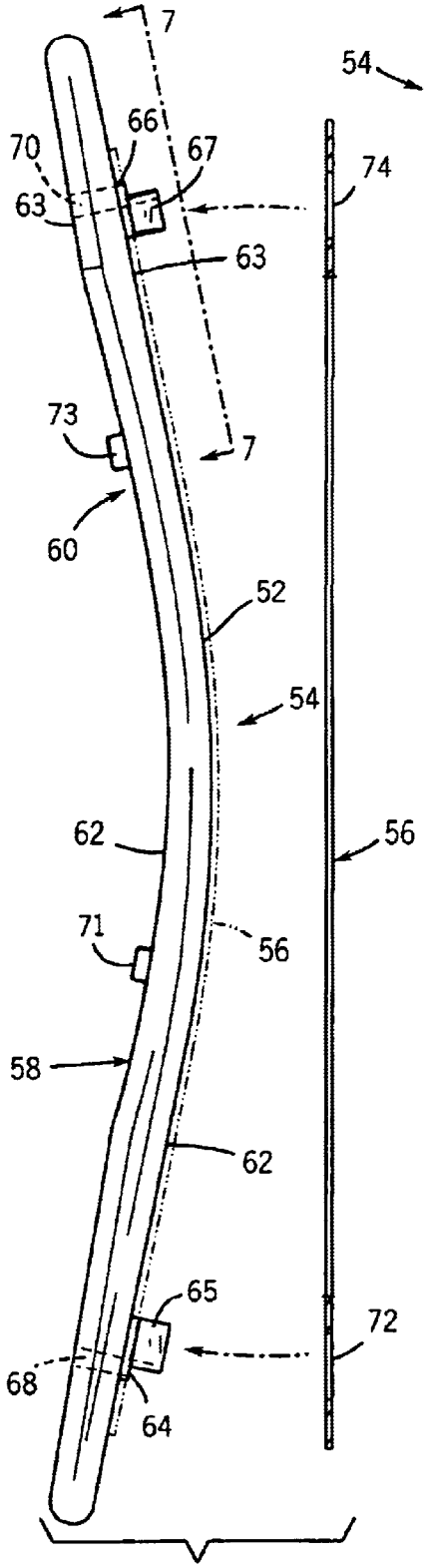
FIG. 6 is an exploded elevation view illustrating the pivot member and the limit strap of the back mounting arrangement incorporated into the chair of FIG. 1.

Referring to FIGS. 4–6, resilient pivot bar 54 includes a lower section 58 and an upper section 60, between which intermediate area 52 is located. Lower section 58 and upper section 60 are angularly offset from each other. Representatively, lower section 58 and upper section 60 are formed so as to define an angle of 159° therebetween, although it is understood that any other satisfactory angle could be utilized. Lower section 58 and upper section 60 define areas of increased thickness 62, 63, respectively. Lower and upper forwardly facing rectangular protrusions 64, 66, respectively, extend outwardly from the forward surface of pivot bar 54. Lower protrusion 64 includes a forward extension 65, and upper protrusion 66 includes a forward extension 67. A pair of apertures 68, 70 extend inwardly from the rear surface of pivot bar 54 at the locations of protrusions 64, 66, respectively. In addition, a lower transverse boss 71 and an upper transverse boss 73 extend rearwardly from the rear surface of pivot bar 54. Pivot bar 54 is formed of any satisfactory resilient material, and representatively may be formed of a nylon 6/6 material, although it is understood that other satisfactory materials may be employed.

Lower protrusion 64 and upper protrusion 66 may be formed to have an identical transverse dimension. The longitudinal dimension of lower protrusion 64 equals the transverse dimension, such that lower protrusion 64 is generally square with slightly rounded corners. The longitudinal dimension of upper protrusion 66 is slightly less than the transverse dimension, such that upper protrusion 66 is generally rectangular, defining a height less than its width. Representatively, lower protrusion 64 has a height and width of 0.480 inches, and upper protrusion 66 has a width of 0.480 inches and height of 0.420 inches.

Figure 7:
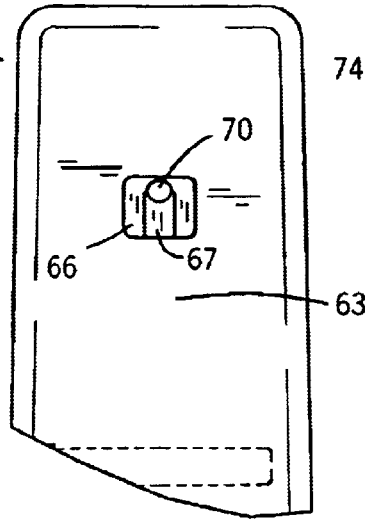
FIG. 7 is a partial elevation view with reference to line 7—7 of FIG. 6.
Figure 8:
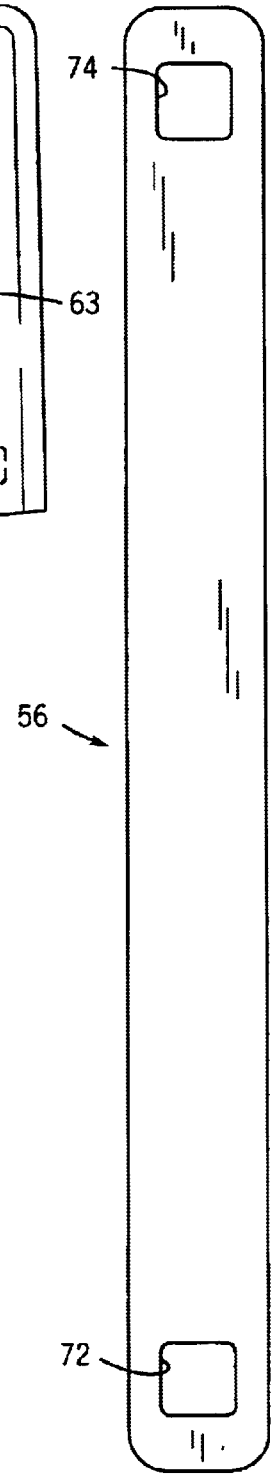
FIG. 8 is an elevation view illustrating the limit strap shown in FIG. 6.
Figure 9:
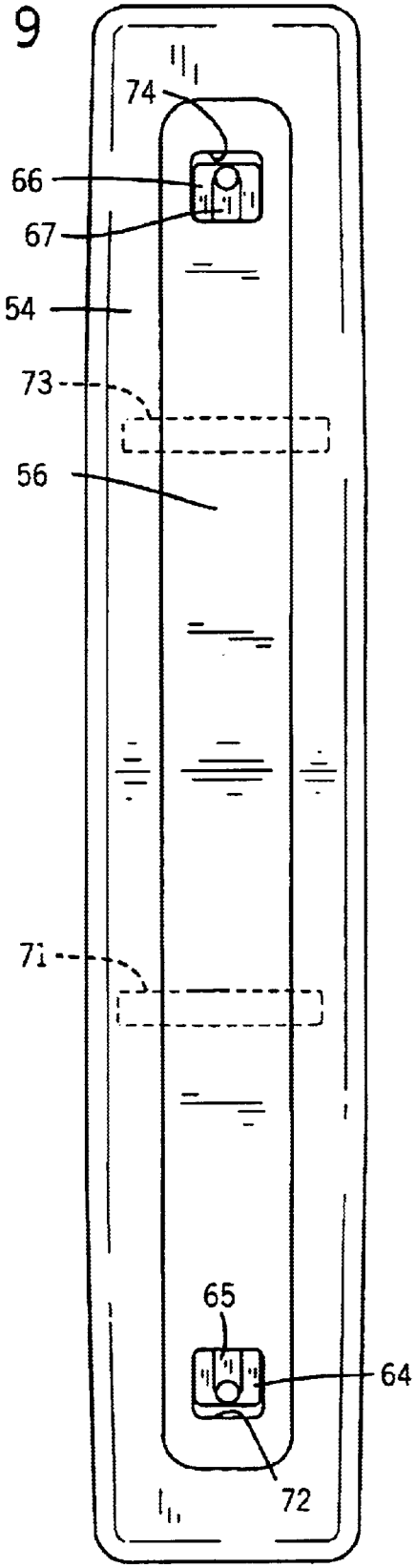
FIG. 9 is a section view taken along line 9—9 of FIG. 4.

Referring to FIGS. 6–8, limit strap 56 is in the form of an elongated rectangular member having a length slightly less than that of pivot bar 54. Lower and upper rectangular openings 72, 74, respectively, are formed adjacent the ends of limit strap 56. Openings 72, 74 have a shape which generally corresponds to that of lower and upper protrusions 64, 66, respectively, in pivot bar 54. Openings 72, 74 each define an area slightly greater than that of lower protrusion 64, and are generally square in shape with rounded comers. Representatively, each side of each opening 72, 74 has a dimension of 0.500 inches. When pivot bar 54 and limit strap 56 are positioned together such that limit strap 56 lies against the front surface of pivot bar 54, lower protrusion 64 is received within lower opening 72, and the close tolerances between the edges of lower protrusion 64 and lower opening 72 substantially fix the lower end of limit strap 56 in position relative to pivot bar 54. Upper protrusion 66 is received within upper opening 74, and the differential in height between upper protrusion 66 and upper opening 74 provides a gap which is located between the upper edge of upper protrusion 66 and the upper edge of upper opening 74, as shown in FIG. 9.

Each resilient pivot member 50, which includes a pivot bar 54 and a limit strap 56, is engaged within the ribbed pocket in one of lower receiver sections 30 defined by passage 32, by fitting limit strap 56 and pivot bar 54 together such that lower protrusion 64 is received within lower opening 72 and the assembled pivot bar 54 and limit strap 56 are inserted into passage 32 so that the lower end of pivot bar 54 bottoms out against the end of passage 32. Forward extension 65 of protrusion 64 fits between a pair of the forward ribs 33*b* of passage 32, and engages the front wall of passage 32. The lower rear area of pivot bar 54 engages the rear ribs 33*a* associated with passage 32. A fastener, such as a threaded screw 75, is then driven in a rearward-to-forward direction through the rear wall of lower receiver section 30 and into aperture 68 in pivot bar lower section 58, to retain pivot bar 54 and limit strap 56 in position relative to seat member 22. Passage 32 and its associated ribs 33*a*, 33*b* are configured to provide a secure mount for the bottom of lower section 58 against rearward and forward movement. A space 80 is defined between the rear surface of pivot bar 54 and the forwardly facing edges of the rear ribs 33*a* of passage 32, at the upper end of pivot bar lower section 58. When engaged with receiver sections 30 in this manner, lower section 58 of pivot member 50 extends upwardly at an angle of approximately 2° forwardly relative to vertical, to provide a slight forward bias for back member 24.

In a similar manner, upper section 60 of pivot member 50 is received within passage 38 formed in upper receiver section 36. The upper end of pivot bar 54 bottoms out against the upper end defined at the merger of ribs 39*a*, 39*b* associated with passage 38, which are configured to maintain the majority of the length of pivot member upper section 60 in a position engaging ribs 39*b* associated with the forward wall of passage 38. Upper transverse boss 73 engages the front edges of ribs 39*a*, to space the upper end of pivot bar 54 forwardly of ribs 39*a*. Forward extension 67 of upper protrusion 66 fits between a pair of forward ribs 39*b* of passage 38, and engages the forward wall of passage 38 between the pair of forward ribs 39*b*. Limit strap 56 is captured between the forward surface of pivot bar 54 and the forward ribs 39*b* of passage 38. A threaded fastener, such as a screw 75, is inserted in a rearward-to-forward direction utilizing an indentation 76 formed in the rear wall of back member 24, and extends into engagement with pivot bar upper section 60 at aperture 70. A space 82 is defined between the rear surface of pivot bar 54 and the forwardly facing edges of the rear ribs 39*a* of passage 38, at the lower end of pivot bar upper section 60.

When pivot members 50 are secured to and between seat member 22 and back member 24 as shown and described, upper section 60 of each resilient pivot member 50 is oriented at approximately a 19° rearward angle relative to vertical. Back member 24 is constructed such that upper back area 34 provides a shape corresponding to the typical configuration of a user's back, in cooperation with lower back area 28 of seat member 22. The orientation of lower section 58 provides a lumbar support feature.

In operation, pivot members 50 function as follows to enable back member 24 to move relative to seat member 22.

When the user leans back against back member 24 to apply rearward pressure on upper back area 34, pivot members 50 flex so as to allow back member 24 to move rearwardly relative to seat member 22. When the rearward pressure on upper back area 34 is relieved, the resiliency of pivot bar 54 returns back member 24 to its normal, at-rest position. During such rearward flexing of pivot bar 54, the front face of pivot bar 54 becomes slightly elongated and the rear face of pivot bar 54 becomes slightly compressed, to enable rearward movement of back member 24 and to provide the forward bias tending to return back member 24 toward its upright, at-rest position. The presence of the gap between the upper edge of upper protrusion 66 and the upper edge of upper opening 74 in limit strap 56 accommodates the slight elongation of the forward surface of pivot bar 54 during normal movement of back member 24.

The configuration and materials of pivot bars 54 are selected so as to provide an increasing resistance feature, i.e. pivot members 50 provide greater resistance as the pivot angle of back member 24 increases. This is in contrast to prior art pivot arrangements, which provide a relatively high initial resistance but which provide low resistance to subsequent movement as the back angle increases. During pivoting movement of back member 24, the upper end of lower section 58 of pivot member 50 first flexes rearwardly to move lower transverse boss 71 into engagement with the front edges of rear ribs 33*a*, to close space 80. Pivot bar 54 then engages the upper areas of the rear ribs 33*a* of lower passage 32, to prevent further flexing of lower section 58. This functions to sequentially shorten the lever arm of pivot member 50, and subsequent bending of pivot bar 54 occurs at the lower end of upper section 60. The lower end of upper section 60 then flexes rearwardly and closes space 82, to engage the lower areas of the rear ribs 39*a* of upper passage 38, to provide resistance to further rearward pivoting movement. Thereafter, intermediate area 52 of pivot bar 54 flexes to provide resistance to movement of back member 24. This construction of the lower receiver section 30, upper receiver section 36 and pivot bar 54, including increased thickness areas 62, 63, is operable to provide a progressive resistance feature which increases bending resistance as back member 24 is increasingly pivoted rearwardly.

Figure 10:
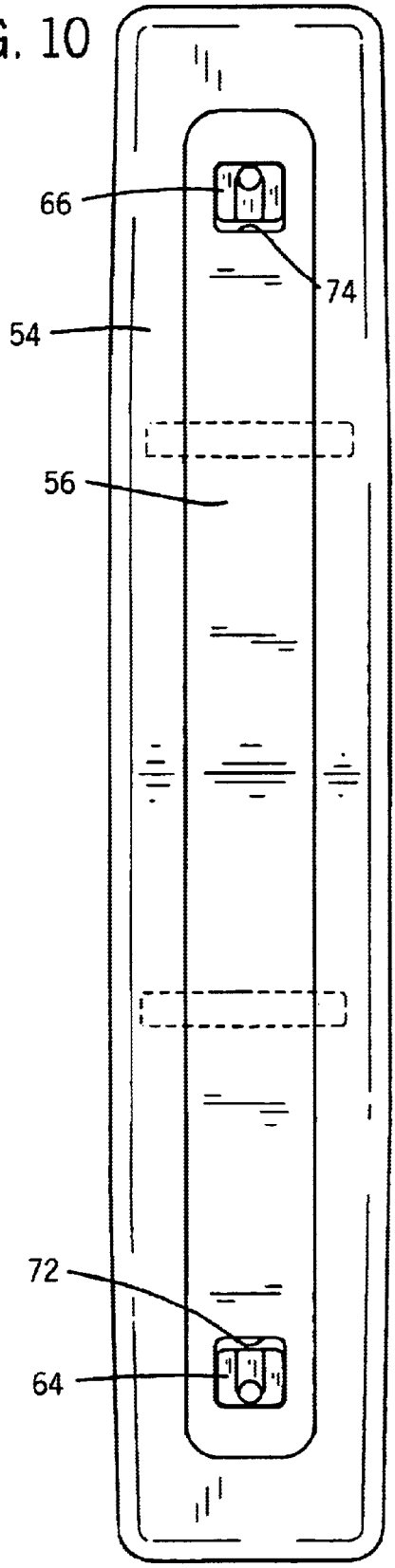
FIG. 10 is a section view taken along line 10—10 of FIG. 5.

When the user exerts a significant rearward force on upper back area 34 to move back member 24 rearwardly, and continues application of such a force, pivot members 50 will flex so as to accommodate such movement until a sufficient angle is attained so as to cause the upper edge of upper protrusion 66 to engage the upper edge of upper opening 74 in limit strap 56, as shown in FIG. 10. When this occurs, further rearward pivoting movement of back member 24 is prevented, such that limit strap 56 is operable to limit rearward movement of back member 24 relative to seat member 22. Again, when the rearward pressure on upper back area 34 is relieved, the resilience of pivot bar 54 functions to return back member 24 to its upright position.

Limit strap 56 is formed of a generally rigid, resilient material such as spring steel 1095, which enables limit strap 56 to be repeatedly flexed and returned to its original condition without fatigue.

Representatively, limit strap 56 and pivot bar 54 are formed so as to provide a pivot stop at a flex angle of approximately 25° back, which has been found to provide sufficient back flex for the majority of users.

The ribs 33*a*, 33*b* and 39*a*, 39*b* defined in lower and upper passages 32, 34, respectively, function to provide a necessary draft for molding of seat and back members 22, 24, respectively, and also function to dissipate forces experienced by pivot bar 54 when pivot bar 54 engages the walls of passages 32, 38, to prevent local failure of pivot bar 54.

While the invention has been shown and described with respect to a particular embodiment, it is understood that alternatives and variations are possible and are contemplated as being within the scope of the present invention. For example, and without limitation, while the limit feature is shown as being associated with the upper pivot bar protrusion and strap opening, it is also possible to provide the limit feature in association with the bottom protrusion and strap opening, or with both the upper and lower protrusions and openings. While the invention has been shown and described in connection with protrusions on the pivot bar and openings in the limit strap, it is also understood that this construction may be reversed in that the protrusions may be provided on the limit strap and the openings or recesses associated with the pivot bar. The limit member has been illustrated as being in the form of a flexible strap-like member, but it is also understood that the limit member may have any other satisfactory configuration. While the limit member has been shown and described as limiting pivoting movement of the back by interacting with the tensioned and elongated front of the pivot strap, it is also understood that a similar type of limiting interaction may be provided in connection with engagement structure associated with the limit member and the compressed rear surface of the limit strap. In addition, while a ribbed pocket configuration is illustrated for receiving the upper and lower ends of the pivot members, it is also contemplated that any other type of receiver structure may be employed for receiving the upper and lower ends of the pivot members. Further, the illustrated back angles are representative only, and it is understood that other back angles may be provided as desired. While the specification and drawings illustrate a pair of pivot members mounted at opposite sides of a chair, it is understood that a similar configuration could be employed in connection with one or several pivot members which operate similarly to that as shown and described.

Further, while limit strap 56 has been shown and described as limiting the extent of rearward movement of back section 24 relative to seat section 22, it is also understood that limit strap 56 may be eliminated and a stop arrangement interposed between the lower end of back section 24 and the upper end of seat section 22, for limiting the extent of rearward pivoting movement of back section 24 relative to seat section 22.

Various alternatives and embodiments are contemplated as being within the scope of the following claims particularly pointing out and distinctly claiming the subject matter regarded as the invention.

I claim:

1. A chair, comprising:

a seat defining a seat area and at least one upwardly facing seat pocket;

a back defining a back engagement area and at least one downwardly facing back pocket; and a resilient elongated pivot member defining a lower section engaged within the seat pocket and an upper section engaged within the back pocket, wherein the pivot member comprises a resilient pivot bar formed of a resilient flexible material, and a limit member which cooperates with the pivot bar to define a limit of rearward movement of the back relative to the seat, wherein the limit member is formed of a rigid resilient material, and wherein the limit member functions to provide a stop against rearward movement or the back by means of interference structure interposed between the pivot bar and the limit member.

2. The chair of claim 1, wherein the interference structure comprises a protrusion formed on the pivot bar and an opening formed in the limit member, wherein the protrusion extends into the opening.

3. The chair of claim 2, wherein the opening and the protrusion are configured to define a gap between an edge of the protrusion and an edge of the opening when the back is in an at-rest position, and wherein rearward movement of the back causes the pivot bar to flex to reduce a dimension of the gap, and wherein rearward movement of the back to a predetermined rearwardmost position causes engagement of the protrusion with the edge of the opening to eliminate the gap and to prevent further rearward movement of the back relative to the seat.

4. The chair of claim 1, wherein the back is spaced above the seat so as to define a space therebetween, and wherein the pivot member includes an intermediate section extending between the lower section received within the seat pocket and the upper section received within the back pocket.

5. The chair of claim 4, wherein a lower portion of the lower section of the pivot member is fixed in position relative to the seat pocket and wherein an upper portion of the lower section is spaced from a forwardly facing surface defined by the seat pocket, wherein initial rearward movement of the back results in engagement of the upper portion of the lower section with the forwardly facing surface of the seat pocket when the back is pivoted to a first predetermined back pivot position relative to the seat, wherein resistance against such initial rearward movement or the back is provided by the lower portion of the lower section of the pivot member prior to engagement with the forwardly facing surface of the seat pocket.

6. The chair of claim 5, wherein a lower portion of the upper section of the pivot member is spaced forwardly from a forwardly facing surface of the back pocket, wherein further pivoting movement of the back beyond the first predetermined position causes the upper section of the pivot member to flex and to move into engagement with the forwardly facing surface of the seat pocket when the back attains a second predetermined back pivot position relative to the seat.

7. The chair of claim 6, wherein resistance to pivoting movement of the back beyond the second predetermined back pivot position is provided by the intermediate section of die pivot member located between the seat and the back.

8. A chair, comprising:

a seat defining a seat area and at least one upwardly facing seat pocket;

a back defining a back engagement area and at least one downwardly facing back pocket; and a pivot bar defining a lower section received within the seat pocket and an upper section received within the buck pocket, wherein an upper extent of the seat pocket and a lower extent of the back pocket are spaced from each other and wherein the pivot bar defines an intermediate area located therebetween;

wherein the seat pocket and the lower section of the pivot bar are configured so as to provide a first space between a forwardly facing wall of an upper portion of the seat pocket and an upper portion of the lower section of the pivot bar, and wherein the back pocket and the upper section of the pivot bar are configured so as to provide a second space between a forwardly facing wall of a lower portion of the back pocket and a lower portion of the upper section of the pivot bar, wherein rearward movement of the back to a first pivot position relative to the seat results in flexing of the lower section of the pivot bar to initially close the first space and engage the upper portion of the lower section of the pivot bar with the forwardly facing wall of the upper portion of the seat pocket, wherein further rearward pivoting movement or the back to a second pivot position relative to the seat results in subsequent closing of the second space and engagement of the lower portion of the upper section of the pivot bar with the forwardly facing wall of the lower portion of the back pocket and flexing or the upper section of the pivot bar, and wherein the seat and the back are configured such that further pivoting movement of the back beyond the second pivot position is resisted by the intermediate area of the pivot bar without engagement between the seat and the back.

9. The chair of claim 8, further comprising a limit member engaged with the pivot bar for limiting the rearward extent of pivoting movement of the back relative to the seat.

10. A chair, comprising:

a seat defining a seat area and at least one upwardly facing seat pocket;

a back defining a back engagement area and at least one downwardly facing seat pocket;

a pivot bar defining a lower section received within the seat pocket and an upper section received within the back pocket, wherein an upper extent of the seat pocket and a lower extent of the back pocket arc spaced from each other and wherein the pivot bar defines an intermediate area located therebetween;

wherein the seat pocket and the lower section of the pivot bar are configured so as to provide a first space between a forwardly facing wall of an upper portion of the seat pocket and an upper portion of the lower section of the pivot bar, and wherein the back pocket and the upper section of the pivot bar are configured so as to provide a second space between a forwardly facing wall of a lower portion or the back pocket and a lower portion of the upper section of the pivot bar, wherein rearward movement of the back to a first pivot position relative to the seat results in flexing of die lower section of the pivot bar to close the first space and engage the upper portion of the lower section of the pivot bar with the forwardly racing wall of the upper portion of the seat pocket, wherein further rearward pivoting movement of the back to a second pivot position relative to the seat results in closing of the second space and engagement of the lower portion of the upper section of the pivot bar with the forwardly facing wall of the lower portion of the back pocket and flexing of the upper section of the pivot bar, and wherein further pivoting movement of the back beyond the second pivot position is resisted by the intermediate area of the pivot bar; and a limit member engaged with the pivot bar for limiting the rearward extent of pivoting movement of the back relative to the seat, wherein the limit member includes an opening and wherein the pivot bar includes a protrusion located within the opening, wherein the opening and the protrusion are configured and arranged such that rearward pivoting movement of the back to a predetermined position relative to the seat causes engagement of an edge of the protrusion with an edge of the opening to prevent pivoting movement of the back beyond a predetermined limit of pivoting movement of the back.

11. The chair of claim 10, wherein the limit member comprises an elongated strap member, wherein the strap member extends along a majority of a length of the pivot bar and includes a lower area which is fixed against movement to the pivot bar and an upper area within which the opening is formed.

12. The chair of claim 11, wherein the pivot bar includes a lower protrusion and wherein the strap member includes a lower opening within which the lower protrusion of the pivot bar is received, wherein the lower protrusion of the pivot bar and the lower opening of the strap member define a mating configuration so as to prevent axial movement between the strap member and the pivot bar.

13. In a chair including a seat and a back, the improvement comprising a resilient elongated pivot member having a lower section engaged with the seat and an upper section engaged with the back, wherein the pivot member comprises a resilient pivot bar formed of a resilient flexible material for providing pivoting movement of the back relative to the seat, and a limit arrangement associated with the pivot member for limiting a range of pivoting movement of the back relative to the seat independent of the seat and the back, wherein the limit arrangement comprises a limit member engaged with the pivot bar for limiting the range of pivoting movement of the back relative to the seat, and wherein the limit member comprises a limit strap separate from the seat and separate from the back, wherein the limit strap and the pivot bar are configured such that the limit strap overlies the pivot bar, wherein the limit strap and the pivot bar include cooperating engagement structure which is operable to stop movement of the back relative to the seat when the back attains a predetermined pivoting position relative to the seat.

14. The improvement of claim 13, wherein the seat defines a seat passage and the back defines a back passage aligned with the seat passage, wherein a lower portion of the pivot bar is received within the seat passage and an upper portion of the pivot bar is received within the back passage.

15. The improvement of claim 14, wherein the pivot bar, the seat and the back are configured so as to provide sequential engagement or the pivot bar with engagement areas defined by the seat and back passages so as to provide a progressively increasing resistance to pivoting movement of the back as a pivot angle of the back relative to the seat increases.

16. In a chair including a seat and a back, and improvement comprising a resilient elongated pivot member having a lower section engaged with the seat and an upper section engaged with the back, wherein the pivot member comprises a resilient pivot bar formed of a resilient flexible material for providing pivoting movement of the back relative to the seat, and a limit arrangement associated with the pivot member for limiting a range of pivoting movement of the back relative to the seat independent of the seat and the back, wherein the limit arrangement comprises a limit member engaged with the pivot bar for limiting the range of pivoting movement of the back relative to the seat, and wherein the limit member comprises a limit strap overlying the pivot bar, wherein the limit strap and the pivot bar include cooperating engagement structure which is operable to stop movement of the back relative to the seat when the back attains a predetermined pivoting position relative to the seat, wherein the cooperating engagement structure comprises a protrusion associated with the pivot bar which extends through an opening formed in the limit strap, wherein the protrusion and the opening are configured such that an edge of the opening engages the protrusion when the back attains the predetermined pivoting position relative to the seat to prevent further pivoting movement of the back relative to the seat.

* * * * *

UNITED STATES PATENT AND TRADEMARK OFFICE

CERTIFICATE OF CORRECTION

PATENT NO. : 6,739,663 B2
DATED : May 25, 2004
INVENTOR(S) : Steven C. Gevaert

It is certified that error appears in the above-identified patent and that said Letters Patent is hereby corrected as shown below:

Column 7,
Line 46, delete “or” and substitute therefore -- of --;

Column 8,
Lines 10, 52 and 55, delete “or” and substitute therefore -- of --;
Line 25, delete “die” and substitute therefore -- the --;
Line 33, delete “buck” and substitute therefore -- back --;

Column 9,
Line 9, delete “die” and substitute therefore -- the --;

Column 9,
Line 22, delete “racing” and substitute therefore -- facing --;
Line 32, delete “and” and substitute therefore -- the --.

Signed and Sealed this

Sixteenth Day of November, 2004

JON W. DUDAS
*Director of the United States Patent and Trademark Office*